US008636376B2

(12) United States Patent
Van Gestel

(10) Patent No.: US 8,636,376 B2
(45) Date of Patent: Jan. 28, 2014

(54) LED LIGHTING INTEGRATED IN A HANDLE

(75) Inventor: Cornelis Johannes Jacobus Antonius Van Gestel, Bladel (NL)

(73) Assignee: B.V. Holmatro Industrial Equipment, Raamsdonksveer (NL)

( * ) Notice: Subject to any disclaimer, the term of this patent is extended or adjusted under 35 U.S.C. 154(b) by 817 days.

(21) Appl. No.: 11/988,015

(22) PCT Filed: Jun. 30, 2006

(86) PCT No.: PCT/NL2006/000325
§ 371 (c)(1),
(2), (4) Date: Jun. 4, 2009

(87) PCT Pub. No.: WO2007/004867
PCT Pub. Date: Jan. 11, 2007

(65) Prior Publication Data

US 2009/0303699 A1 Dec. 10, 2009

(30) Foreign Application Priority Data

Jun. 30, 2005 (NL) ..... 1029381

(51) Int. Cl.
*B25B 23/18* (2006.01)

(52) U.S. Cl.
USPC ..... 362/119; 362/120

(58) Field of Classification Search
USPC ..... 362/119–120
See application file for complete search history.

(56) References Cited

U.S. PATENT DOCUMENTS

| | | | | |
|---|---|---|---|---|
| 3,152,650 | A | 10/1964 | Savidge | |
| 5,873,647 | A | 2/1999 | Kurtz et al. | |
| 5,956,992 | A * | 9/1999 | Patton | 72/392 |
| 6,179,433 | B1 * | 1/2001 | Shiao | 362/120 |
| 6,511,200 | B2 * | 1/2003 | Matsunaga | 362/119 |
| 2002/0105797 | A1 * | 8/2002 | Navid et al. | 362/120 |
| 2003/0058637 | A1 * | 3/2003 | Hsien | 362/119 |
| 2004/0174699 | A1 | 9/2004 | Minalga | |
| 2005/0073836 | A1 | 4/2005 | Prell et al. | |

FOREIGN PATENT DOCUMENTS

| | | |
|---|---|---|
| DE | 25 29 668 | 1/1977 |
| DE | 28 19 691 | 11/1979 |
| DE | 3 015 805 | 10/1981 |
| DE | 8 529 779 | 12/1985 |
| DE | 3 525 980 | 1/1987 |
| DE | 8 912 224 | 12/1990 |
| EP | 1 068 934 | 1/2001 |
| GB | 2 407 058 | 4/2005 |
| JP | 10-034566 | 2/1998 |
| NL | 8 202 317 | 1/1984 |
| WO | WO 99/02310 | 1/1999 |

* cited by examiner

*Primary Examiner* — Sean Gramling
(74) *Attorney, Agent, or Firm* — Harness, Dickey & Pierce, P.L.C.

(57) ABSTRACT

In one embodiment of the present invention, a lighting element integrated into a handle or hand-grip of a tool is disclosed, including at least one, but preferably two lighting fittings which have a modular constructions such that a lamp holder and a lens holder can be mounted in diverse positions relative to the longitudinal axis, and with which the direction of the light beam can be adjusted to the shape and size of the handle.

17 Claims, 4 Drawing Sheets

LED LIGHTING INTEGRATED IN A HANDLE

The invention relates to a lighting element for a handle or hand-grip of a portable tool. The invention also relates to a carrying element with such a lighting element, and to a portable tool provided with such a carrying element.

The handle is especially intended for use on so-called rescue tools which must be used in the most varied conditions. The area of operation of the tool is often unlit since the operator stands with his back to the light. Particularly in the case of cutting operations on a vehicle, such as cutting the hinges of a door, this is perceived as very inconvenient.

It is an object of the invention to obviate this drawback of the prior art.

According to a first aspect of the invention, there is provided for this purpose a lighting element integrated into a handle or hand-grip of a tool, comprising at least one lighting fitting which is adapted to adjust the direction of the beam of light emitted by the lighting to the shape and size of the handle, and thereby to the type of tool.

According to a first preferred embodiment, the lighting element comprises at least two lighting fittings which are adapted to direct the beams of light at the area of operation of the tool. A better lighting of the area of operation is hereby obtained so that the object for processing and the active part of the tool remain more readily visible. The chance is furthermore reduced of too little light reaching the area of operation, for instance when a beam of light is interrupted by the object or by the operator.

According to a further preferred embodiment, the lighting fittings are adapted to direct the beams of light substantially at a shared area of operation. Two or more beams of light will therefore overlap at least partially in the area of operation, thus reducing the chance of the area of operation being illuminated insufficiently through obstruction of a light beam.

The LED fittings placed in the handle have a modular construction such that they can always be mounted at the correct angle relative to the area of operation. This is achieved by embodying the different components of the LED fitting such that they can be mounted in different positions relative to each other. The light output of the LEDs can hereby be utilized optimally and the LED fittings can be used in different tools.

The control unit is fastened in the handle by means of screws. Replacement of the battery can take place in simple manner by unscrewing the lid or the cover from the unit.

Electronics developed especially for this LED lighting are placed in the control unit, and ensure that the voltage available in the battery is distributed and utilized optimally so that a runtime of about four hours can be realized with a practically constant light output.

The lighting element is preferably embodied in plastic components, whereby a protection class in accordance with IP 55 is obtained, whereby the handle can be applied in all occurring weather conditions.

According to another aspect of the present invention a carrying element is provided for a portable tool, comprising a handle or hand-grip provided with a hollow space, in which hollow space are arranged one or more lighting fittings of a lighting element as defined herein. The operator of the tool is hereby not impeded, or hardly so, by the presence of the lighting. This is particularly the case when the lighting element is substantially fully recessed into the handle or hand-grip.

In the case that the lighting element comprises two or more fittings with two or more lamps, the power supply is preferably provided by a single power supply which is often, but not always, positioned centrally in the handle. The power supply for instance comprises one or more batteries which can be changed easily and quickly.

In a further preferred embodiment the handle or hand-grip comprises a part which protrudes laterally over a predetermined distance relative to the tool and in which the fittings are arranged. Said distance has a length (typically a few centimeters) such that on the one hand the tool can be easily handled and on the other the beams of light are obstructed relatively little, for instance as a result of shading effect of the tool, since they can be directed at the area of operation from different positions and preferably also at different angles.

According to a further preferred embodiment, the handle or hand-grip extends at least partially around the tool and the lighting fittings are arranged in the handle or hand-grip at a substantially maximum intermediate distance. The intermediate distance is in practice made as great as possible so as to cause as little obstruction of the light beams as possible.

According to a further preferred embodiment, the control unit of the lighting fittings is partially or preferably wholly recessed into the handle or hand-grip so that the operator is obstructed less or not at all by protruding parts.

The carrying element is applied particularly in portable tools of the type used for rescues, such as a spreader or cutter.

Further advantages, features and details of the present invention will be elucidated on the basis of the following description of several embodiments thereof. Reference is made in the description to the accompanying figures, in which.

The preferred embodiment of the invention described herein relates to a combination not previously applied of a handle, also referred to as a hand-grip, of a tool having placed therein one or more LED lighting fittings which, together with a control unit and the power supply integrated therein on the basis of a standard 1.5 V replaceable battery, illuminates the area of operation of the tool in question.

Figure 4:
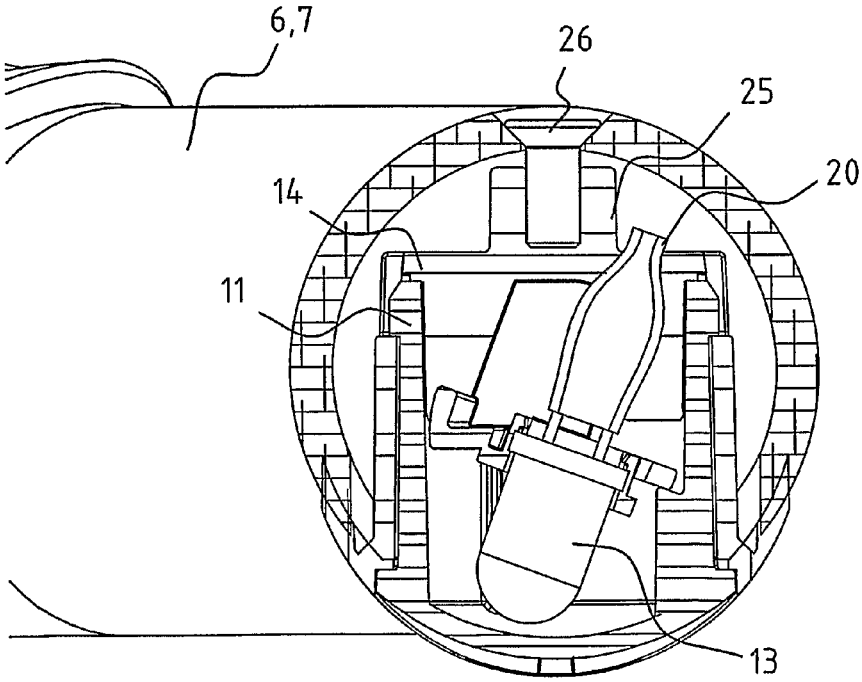
FIG. 4 shows a cross-section of an assembled LED lighting fitting.
Figure 5:
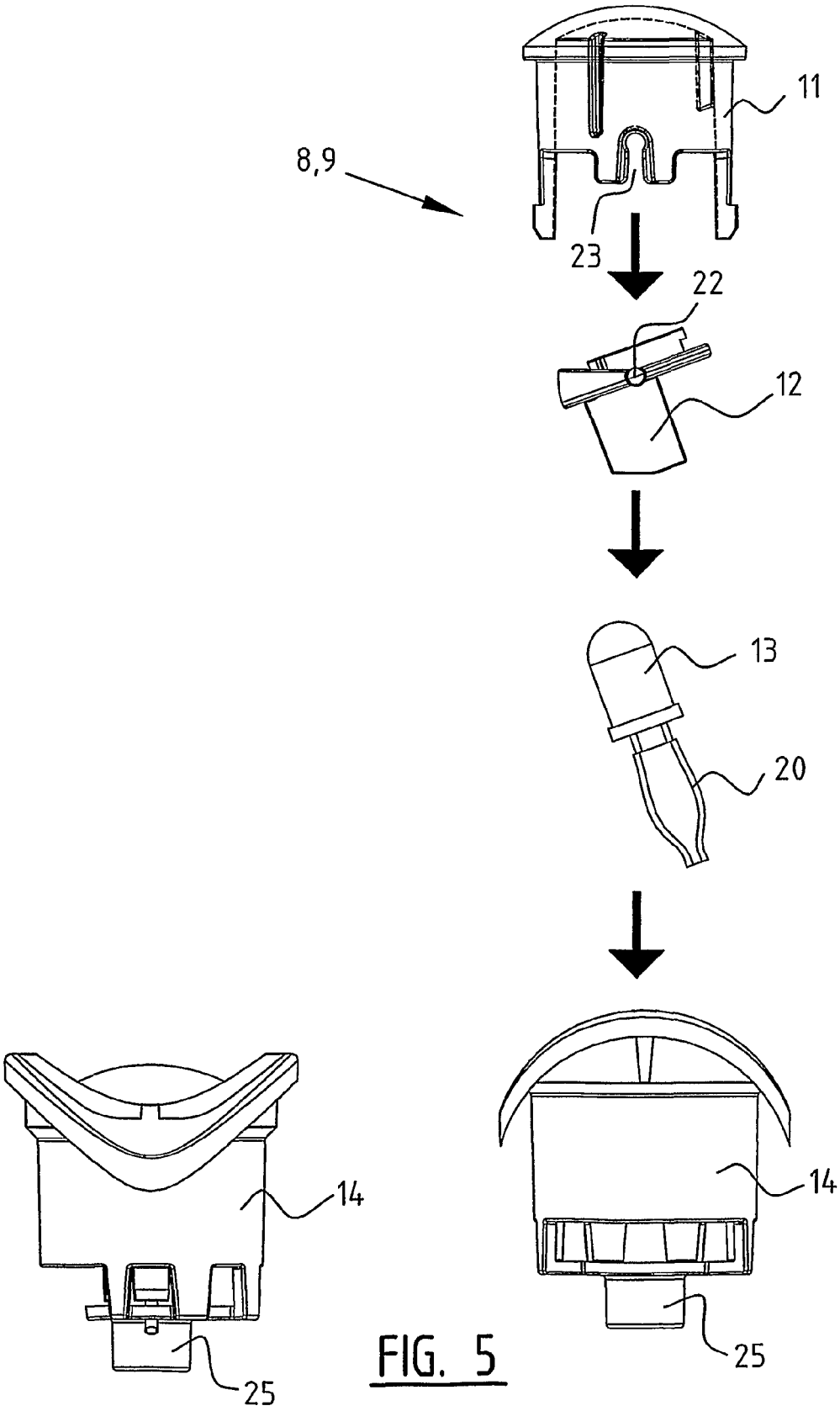
FIG. 5 shows the different components from which a preferred embodiment of the LED fitting according to this invention is assembled.
Figure 6:
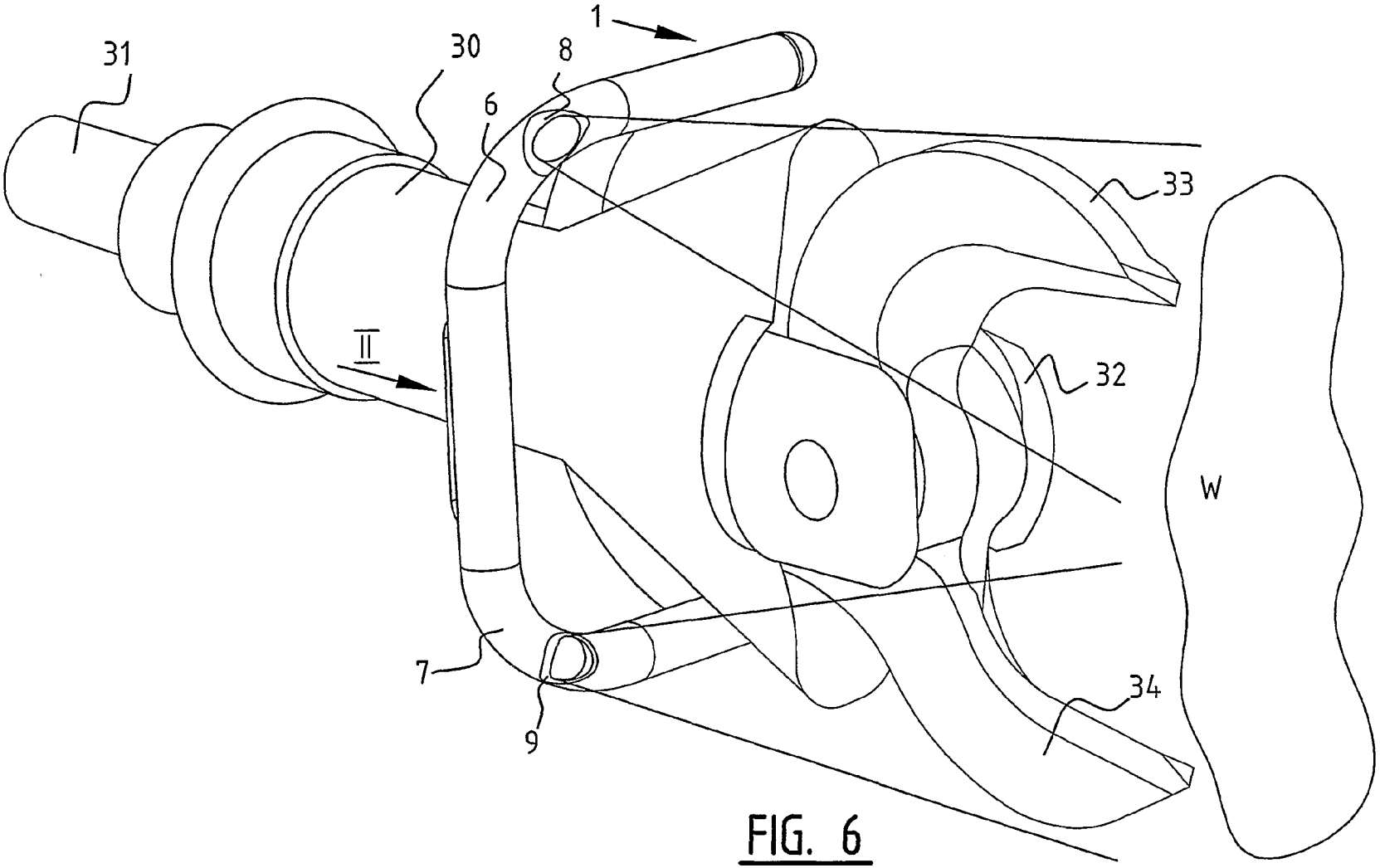
FIG. 6 shows a perspective view of a portable rescue tool provided with a preferred embodiment of a carrying element and lighting element according to the invention.

FIGS. 1-6 show a preferred embodiment of a rescue tool provided with a preferred embodiment of a carrying element 1 with lighting according to the present invention. FIG. 6 shows rescue shears or a cutter 30 connected to hydraulic conduits 31. Cutter 30 is provided at its outer end with a hinge construction 32 around which two shear blades 33, 34 can rotate. Provided inside the tool is a hydraulic cylinder (not shown), which is connected on one side to hydraulic conduits 31 and on the other to fastening tongues (not shown) provided on shear blades 33, 34. The hydraulic cylinder provides for closing and opening of cutting blades 33, 34, for instance for cutting open a vehicle. Such a rescue tool is generally known and a detailed description hereof will not be given.

Tool 30 is provided with a handle 1. Handle 1 is used by an operator to grip the tool and has a shape such that the tool is easy to handle. Handle 1 is provided for a large part around tool 30 and at some distance (several centimeters) therefrom so that the operator can grip handle 1 at any desired position.

FIG. 6 further shows that a first lighting element 8 and a second lighting element 9 are arranged in handle 1, and more specifically in respective curved parts 6, 7 thereof. Both lighting elements 8, 9 can emit light in the direction of the area in which tool 30 is being operated, also referred to as area of operation (W).

FIG. 6 also shows that the light beams emitted by lighting elements 8,9 converge to some extent so that the beams partially or wholly overlap at the position of area of operation W. In other embodiments (not shown) lighting elements 8, 9 are arranged such that the light beams emitted thereby do not converge, but for instance run parallel to each other or diverge relative to each other.

Figure 1:
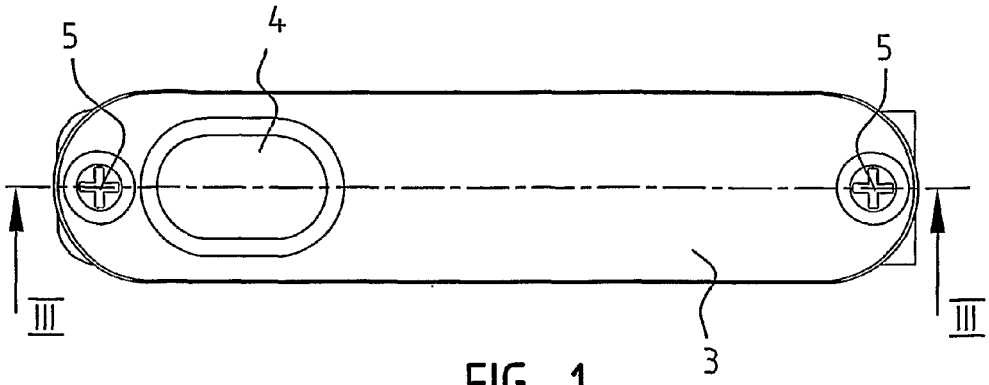
FIG. 1 shows a view of a preferred embodiment of the control unit for a lighting element in a handle according to the invention, on the operating side.
Figure 2:
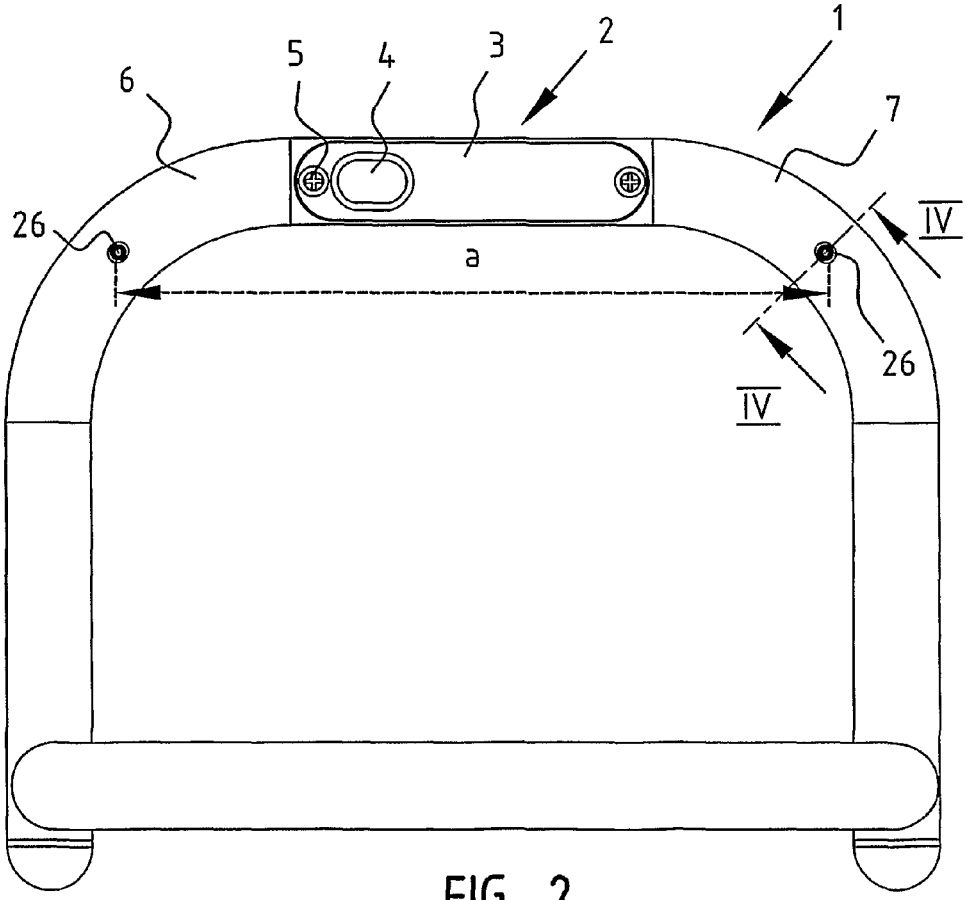
FIG. 2 shows a rear view of the preferred embodiment of the handle with lighting element mounted in a typical handle for rescue tools.

As shown in more detail in FIGS. 1 and 2, a control element 2 is provided on the rear of handle 1. Control element 2 comprises a cover 3 with which a hollow space 29 (see FIG. 3) can be closed off. Using screws 5 arranged on either side of cover 3, cover 3 can be screwed fixedly to profile parts 14 present in space 29. Control element 2 further comprises an on/off button 4 with which lighting can be switched on and off.

Figure 3:
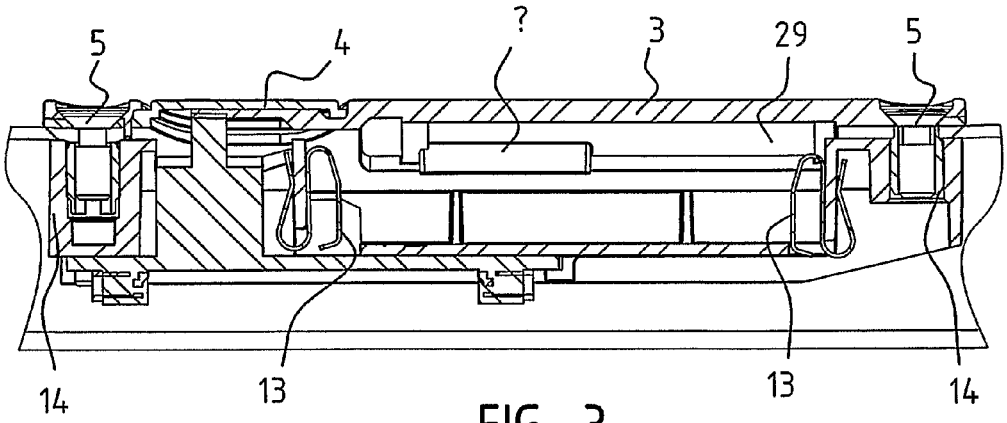
FIG. 3 shows a partly cut-away cross-section of the control unit with the clamps for placing the AA battery being clearly visible.

As clearly shown in the cross-section of FIG. 3, diverse components, such as an electronic power supply and the control electronics optionally combined therewith, can be arranged in hollow space 29 in handle 1. In the shown embodiment both lighting elements 8, 9 are fed by a centrally disposed power supply, consisting of a number of optionally rechargeable batteries (not shown). The batteries are in contact in known manner with terminals 13 (FIG. 3), which are connected to lighting elements 8, 9 via the on/off button 4 and electric wiring (not shown).

A preferred embodiment of a lighting element is shown in more detail in FIGS. 4 and 5. FIG. 5 shows on the right and from top to bottom a lens 11, a lamp holder 12, a lamp 13 and a lens holder 14. FIG. 5 also shows on the left the lens holder 14 in a position rotated through 90°. Lamp 13 (preferably an LED) is placed in lamp holder 12, which is then placed in a recess of the lens, this such that a protrusion 22 can be pushed into two slots 23 of lens 11. Lamp 13 can be arranged mounted in lens 11 and lamp holder 12 at different angles in a number of ways at random (two ways in the shown embodiment) using connecting clips 20. The assembly of lens 11, lamp holder 12 and lamp 13 is then placed in lens holder 14, which lens holder 14 is then rotatable in one direction. The lens holder is placed in a suitable position in handle 1. Lens holder 14 is provided on its underside with a protruding part 25 on which a screw 26 can be arranged in order to fix the assembly relative to handle 1. Because the lamp can be placed on the handle at different angles relative to the normal, and lens holder 14 is moreover rotatable, lamp 13 can emit light beams in random directions. The lighting element can hereby be applied with different handles, and thus on different tools.

In the shown embodiments the lighting elements 8, 9 are positioned in handle 1 such that the mutual distance A (FIG. 2) is practically maximal. This means that area of operation W is illuminated from several points, which enables a more uniform lighting of the area of operation, and furthermore reduces the chance of the light beams being obstructed, for instance when an operator holds his/her hand in front of a lighting element 8.

The invention is not limited to the preferred embodiments thereof described herein. The rights sought are rather defined by the following claims, within the scope of which many modifications can be envisaged.

The invention claimed is:

1. A handle or hand-grip of a tool, comprising:

at least two lighting elements integrated into the handle or hand-grip of the tool, at least one lighting element being adaptably adjustable to adjust the direction of the beam of light emitted by the lighting element relative to the shape and size of the handle and to direct a beam of light at an area of operation of the tool, wherein the handle or hand-grip is spaced apart from and extends at least partially around the tool and the at least two lighting elements are arranged in the handle or hand-grip at a distance from one another such that beams of light emitted from the at least two lighting elements are obstructed as little as possible, and wherein each of the at least two lighting elements include a lamp holder, a lamp placeable in the lamp holder, a lens connectable to the lamp holder and a lens holder for receiving an assembly of the lamp, the lamp holder and the lens.

2. The handle or hand-grip of a tool as claimed in claim 1, wherein the at least two lighting elements are adapted to direct the beams of light substantially at a shared area of operation.

3. The handle or hand-grip of a tool as claimed in claim 1, wherein the at least two lighting elements have a modular construction such that the lamp holder and the lens holder can be mounted in diverse positions relative to the handle or hand-grip.

4. The handle or hand-grip of a tool as claimed in claim 1, further including an integrated control unit which is provided with a battery.

5. The handle or hand-grip of a tool as claimed in claim 1, which is embodied in plastic components, whereby a protection class in accordance with IP 55 is obtained.

6. The handle or hand-grip of a tool as claimed in claim 4, provided with electronics which are adapted to make optimal use of the voltage available in the battery.

7. The handle or hand-grip of a tool as claimed in claim 1, further comprising a power supply of at least one of replaceable and rechargeable batteries, integratable into the handle.

8. The handle or hand-grip of a tool as claimed in claim 4, equipped with electronics adapted to switch off the lighting element automatically after a determined period in order to save the battery.

9. The handle or hand-grip of a tool as claimed in claim 1, wherein the lamp in the lamp holder is at least one of a halogen lamp and an LED.

10. A portable tool, provided with a handle or hand-grip of a tool as claimed in claim 1.

11. The handle or hand-grip of a tool as claimed in claim 1, wherein the handle is spaced apart from the tool at a distance sufficient to receive at least a portion of an operator's hand between the tool and the handle or hand-grip.

12. A carrying element for a portable tool, comprising:

a handle or hand-grip provided with a hollow space, in which hollow space is arranged at least two lighting elements; wherein the at least two lighting elements are adapted to direct the beams of light at an area of operation of the tool, wherein the handle or hand-grip is spaced apart from and extends at least partially around the tool and the lighting elements are arranged in the handle or hand-grip at a distance from one another such that beams of light emitted from the at least two lighting elements are obstructed as little as possible, and wherein each of the at least two lighting elements include a lamp holder, a lamp placeable in the lamp holder, a lens connectable to the lamp holder and a lens holder for receiving an assembly of the lamp, the lamp holder and the lens.

13. The carrying element as claimed in claim 12, wherein the at least two lighting elements are substantially fully recessed into the handle or hand-grip.

14. The carrying element as claimed in claim 12, comprising a single power supply for the at least two lighting elements placed at a distance from each other.

15. The carrying element as claimed in claim 12, wherein the handle or hand-grip comprises a part which protrudes laterally over a distance relative to the tool and in which the lighting elements are arranged, said distance having a length such that the tool can be easily handled and the beams of light are less subject to obstructions from the tool.

16. The carrying element as claimed in claim 12, further comprising a control unit configured to control the lighting elements, the control unit being at least partially recessed into the handle or hand-grip.

17. A portable tool, provided with a carrying element as claimed in claim 12.

* * * * *